US006035154A

United States Patent [19]

Takahata et al.

[11] Patent Number: 6,035,154

[45] Date of Patent: Mar. 7, 2000

[54] IMAGE FORMING APPARATUS

[75] Inventors: Toshiya Takahata; Takehiko Okamura; Toshihiko Yamazaki, all of Nagano, Japan

[73] Assignee: Seiko Epson Corporation, Tokyo, Japan

[21] Appl. No.: 09/198,598

[22] Filed: Nov. 24, 1998

[30] Foreign Application Priority Data

Nov. 28, 1997 [JP] Japan ..... 9-344025
Nov. 28, 1997 [JP] Japan ..... 9-344026

[51] Int. Cl.[7] ..... G03G 15/16

[52] U.S. Cl. ..... 399/66; 399/44; 399/101

[58] Field of Search ..... 399/44, 66, 94, 399/97, 98, 101, 302, 308

[56] References Cited

U.S. PATENT DOCUMENTS

| | | | |
|---|---|---|---|
| 4,931,839 | 6/1990 | Tompkins et al. | 399/66 |
| 5,253,022 | 10/1993 | Takeuchi et al. | 399/313 |
| 5,621,509 | 4/1997 | Karashima et al. | 399/66 X |
| 5,689,771 | 11/1997 | Sato et al. | 399/101 |
| 5,717,981 | 2/1998 | Yamanaka | 399/101 |
| 5,822,648 | 10/1998 | Mohri | 399/66 X |
| 5,907,746 | 5/1999 | Kubota | 399/101 |
| 5,940,668 | 8/1999 | Tanigawa et al. | 399/302 |
| 5,953,572 | 9/1999 | Takeuchi et al. | 399/302 |
| 5,966,561 | 10/1999 | Yamaguchi | 399/66 |
| 5,966,564 | 10/1999 | Kizaki et al. | 399/101 |

FOREIGN PATENT DOCUMENTS 1-319078 12/1989 Japan .

*Primary Examiner*—Matthew S. Smith
*Attorney, Agent, or Firm*—Sugrue, Mion, Zinn, Macpeak & Seas, PLLC

[57] ABSTRACT

An image forming apparatus includes a latent image carrier in which an electrostatic latent image is formed on the surface thereof, development unit or units for applying charged developer to the surface of the latent image carrier to visualize the latent image, an intermediate transfer body which is abutted against the latent image carrier, and to which the primary transfer voltage of polarity reverse to the charging polarity of the developer is applied and on which the visible image is primarily transferred, a secondary transfer member which is abutted against the intermediate transfer body through a recording medium and to which the secondary transfer voltage is applied to transfer the visible image on the recording medium, and a voltage applying mechanism for applying the secondary transfer voltage of the same polarity as the primary transfer voltage and larger than the primary transfer voltage in an absolute value to the secondary transfer member in case the secondary transfer is executed, and for applying a cleaning voltage of the same polarity as the primary transfer voltage and smaller than the primary transfer voltage in an absolute value to the secondary transfer member in a predetermined period in case the secondary transfer is unexecuted.

12 Claims, 4 Drawing Sheets

IMAGE FORMING APPARATUS

BACKGROUND OF THE INVENTION

The present invention relates to an image forming apparatus such as a printer, a facsimile and a copying machine for forming an image using electrophotographic technology. Particularly, the present invention relates to cleaning technique of a transfer member for transferring an image on a recording medium such as paper.

Generally, an image forming apparatus using electrophotographic technology is provided with a photoconductor drum provided with a photosensitive layer on the peripheral surface as a latent image carrier, charging means for uniformly charging the peripheral surface of the photoconductor drum, exposure means for forming an electrostatic latent image by selectively exposing the peripheral surface uniformly charged by the charging means, development means for applying charged toner as developer to an electrostatic latent image formed by the exposure means to form a visible image (a toner image) and a transfer device for transferring a toner image developed by the development means on a recording medium such as paper.

For example, a conventional type image forming apparatus disclosed in Unexamined Japanese Patent Publication No. Hei 1-319078 shown in FIG. 5 is known.

The image forming apparatus is provided with an charging device 2 for uniformly charging a photosensitive layer on the surface of a cylindrical image carrier, an exposing section 3 for irradiating optical information such as a laser beam on the charged surface to form an electrostatic latent image, a developing machine 4 for supplying toner to the latent image to visualize the image, a transfer roller 5 abutted against the above image carrier 1 as a transfer member for transferring a toner image on a recording medium fed to the nipping part through a supplying passage 6, a power source 7 for applying developing bias to a developing part of the developing machine 4 and a power source 8 for applying transfer bias to the transfer roller 5 around the cylindrical image carrier 1 extended in a direction perpendicular to the surface of paper and rotated in a direction shown by an arrow A.

An image forming process by the image forming apparatus is as follows:

First, the photosensitive layer of the image carrier 1 is charged by a corona charger 2 so that the photosensitive layer is −700 V.

Next, the voltage of an irradiated area is attenuated to −100 V by irradiating optical information by the exposing section 3 and an electrostatic latent image is formed in the part.

Developing bias of −500 V is applied to the developing machine 4 by the power source 7, toner charged in negative polarity adheres to the part in which electric potential is attenuated by the reversal development and thereby a toner image is formed.

In the meantime, transfer material not shown supplied through the supplying passage 6 reaches the nipping portion between the image carrier 1 and the transfer roller 5 at the same timing as the above toner image, transfer bias of +500 V is applied to the transfer roller 5 by the power source 8 when the transfer material passes and a toner image is transferred on the transfer material.

The conventional type image forming apparatus is constituted so that when optical information is not irradiated on the image carrier 1, the charging device 2 is stopped so that the surface potential of the image carrier 1 is 0 V, when an uncharged area in which surface potential is zero is located in the nipping portion between the image carrier 1 and the transfer roller 5, that is, when no transfer material passes, bias of the same polarity as toner and of polarity reverse to the above transfer bias, namely −500 V, is applied to the transfer roller 5, hereby, toner which adheres to the transfer roller 5 is moved to the image carrier 1 and the transfer roller 5 is cleaned up.

There is a problem that as the above conventional type transfer device is constituted so that positive voltage of +500 V is applied to the transfer roller 5 when a toner image is transferred on transfer material and negative voltage of −500 V is applied to the transfer roller when the transfer roller 5 is cleaned up, a high voltage relay and others for switching applied voltage are required and the structure of a high voltage power supply unit is complicated.

SUMMARY OF THE INVENTION

The object of the present invention is to solve the above problem and provide an image forming apparatus wherein a transfer member can be cleaned up without requiring a complicated high voltage power supply unit.

In order to achieve the above object, according to the first aspect of the invention, there is provided an image forming apparatus comprising: a latent image carrier in which an electrostatic latent image is formed on the surface thereof; development means for applying charged developer to the surface of the latent image carrier to visualize the latent image; an intermediate transfer body which is abutted against the latent image carrier, the intermediate transfer body to which the primary transfer voltage of polarity reverse to the charging polarity of the developer is applied and on which the visible image is primarily transferred; a secondary transfer member which is abutted against the intermediate transfer body through a recording medium and to which the secondary transfer voltage is applied to transfer the visible image on the recording medium; and voltage applying means for applying the secondary transfer voltage of the same polarity as the primary transfer voltage and larger than the primary transfer voltage in an absolute value to the secondary transfer member in case the secondary transfer is executed, and for applying the cleaning voltage of the same polarity as the primary transfer voltage and smaller than the primary transfer voltage in an absolute value to the secondary transfer member in a predetermined period in case the secondary transfer is unexecuted.

The image forming apparatus may further include: a temperature sensor for detecting ambient temperature of the apparatus; a humidity sensor for detecting ambient humidity of the apparatus; and a control section for determining potential difference between the primary transfer voltage and the cleaning voltage based on a result of the detection by the temperature sensor and the humidity sensor and for determining the value of the primary transfer voltage and the cleaning voltage so that the determined potential difference is made.

In the apparatus, the primary transfer voltage and the cleaning voltage may be determined so as to the potential difference is relatively large in case low temperature and low humidity are detected by the sensors.

In the apparatus, the primary transfer voltage and the cleaning voltage may be determined so as to the potential difference is relatively small in case the high temperature and high humidity are detected by the sensors.

According to the above image forming apparatus, an electrostatic latent image is formed on the surface of the latent image carrier, developer charged by the development means is applied to the surface of the latent image carrier to visualize the above latent image, the primary transfer voltage of polarity reverse to the charging polarity of the developer is applied to the intermediate transfer body abutted against the latent image carrier and a visible image is primarily transferred on the intermediate transfer body and the visible image is transferred on a recording medium by applying the secondary transfer voltage to the secondary transfer member abutted against the intermediate transfer body via recording medium.

Since the secondary transfer voltage of the same polarity as the primary transfer voltage and larger than the primary transfer voltage in an absolute value is applied to the secondary transfer member by the voltage applying means in case the secondary transfer is executed, a visible image is securely secondarily transferred on a recording medium. Since in a predetermined period in case the secondary transfer is unexecuted, the cleaning voltage bf the same polarity as the primary transfer voltage and smaller than the primary transfer voltage in an absolute value is applied to the secondary transfer member by the voltage applying means in a state in which the primary transfer voltage is applied to the intermediate transfer body, potential difference is generated between the secondary transfer member and the intermediate transfer body, developer which adheres to the secondary transfer member is moved to the intermediate transfer body because of the potential difference and as a result, the secondary transfer member is cleaned up.

Therefore, as voltage applied to the secondary transfer member is not required to be switched between when a visible image is transferred on a recording medium and when the secondary transfer member is cleaned up, the secondary transfer member can be cleaned up without requiring a complicated high voltage power supply unit.

Potential difference required to efficiently move developer which adheres to the secondary transfer member to the intermediate transfer body is different depending upon ambient temperature and humidity.

In case there are provided the temperature sensor and the humidity sensor respectively for detecting the ambient temperature and humidity of the apparatus and the control section for determining difference between the primary transfer voltage and the cleaning voltage based on a result of the detection by these sensors and for determining the value of the primary transfer voltage and the cleaning voltage so that the above difference is made, potential difference required to efficiently move developer which adheres to the secondary transfer member to the intermediate transfer body can be generated corresponding to ambient temperature and humidity by the control section.

Therefore, the secondary transfer member can be more efficiently cleaned up without requiring a complicated high voltage power supply unit.

According to the second aspect of the invention, the voltage applying means may be constituted so that no voltage is applied to the secondary transfer member to the secondary transfer member in a predetermined period in case the secondary transfer is unexecuted.

The image forming apparatus may further include: a temperature sensor for detecting ambient temperature of the apparatus; a humidity sensor for detecting ambient humidity of the apparatus; and a control section for determining the value of the primary transfer voltage based on a result of the detection by the temperature sensor and the humidity sensor.

In the apparatus, the primary transfer voltage may be determined so as be relatively high in case low temperature and low humidity are detected by the sensors.

In the apparatus, the primary transfer voltage may be determined so as to be relatively low in case high temperature and high humidity are detected by the sensors.

According to the above image formation apparatus, since the potential difference between the secondary transfer member and the intermediate transfer body becomes large in compare with the case of the secondary transfer voltage is applied, the clean up effect of the secondary transfer member can be improved.

Further, as descried above, the potential difference required to efficiently move developer which adheres to the secondary transfer member to the intermediate transfer body is different depending upon ambient temperature and humidity. Since the image forming apparatus comprises the temperature sensor and the humidity sensor for detecting the ambient temperature and humidity of the apparatus and the control section for determining the value of the primary transfer voltage based on a result of the detection by these sensors, the required potential difference can be generated by determining the value of the primary transfer voltage based on the ambient temperature and humidity by the control section.

Therefore, the secondary transfer member can be further efficiently cleaned up without requiring a complicated high voltage power supply unit.

According to the third aspect of the invention, the intermediate transfer body may include a conductive layer to which the primary transfer voltage is applied.

According to the above image formation apparatus, electric potential at a portion where the secondary transfer member abuts against the intermediate transfer body is substantially equal to the primary transfer voltage applied to the intermediate transfer body via conductive layer.

Since the electric potential in the part pressing the secondary transfer member of the intermediate transfer body is considerably lower than the primary transfer voltage applied to the intermediate transfer body, assuming that the intermediate transfer body is composed of only a resistance layer as in a conventional type, the primary transfer voltage applied to the intermediate transfer body is required to be considerably increased to generate the above potential difference (that is, potential difference generated between the secondary transfer member and the intermediate transfer body by applying voltage of the same polarity as the primary transfer voltage and smaller than the primary transfer voltage in an absolute value to the secondary transfer member or by applying no voltage to the secondary transfer member in a state in which the primary transfer voltage is applied to the intermediate transfer body).

To the contrary, in the above apparatus, since the electric potential in the part where the secondary transfer member abuts against the intermediate transfer body is substantially equal to the primary transfer voltage applied to the intermediate transfer body, the above potential difference required for cleaning the secondary transfer member can be generated without increasing the primary transfer voltage so much. In other words, since the above potential difference required for cleaning the secondary transfer member can be generated by utilizing the primary transfer voltage applied to the intermediate transfer body approximately as it is, the primary transfer voltage can be reduced as a result.

According to the fourth aspect of the invention, the voltage applying means may be composed of a current attraction type of power source.

Therefore, since the above voltage applying means is composed of a current attraction type of power source, stable electric potential can be kept even if current flows reversely to that in transfer and electric potential required for cleaning can be secured:

DETAILED DESCRIPTION OF THE PREFERRED EMBODIMENTS

Referring to the accompanying drawings, preferred embodiments of the present invention will be described below.

Figure 1:
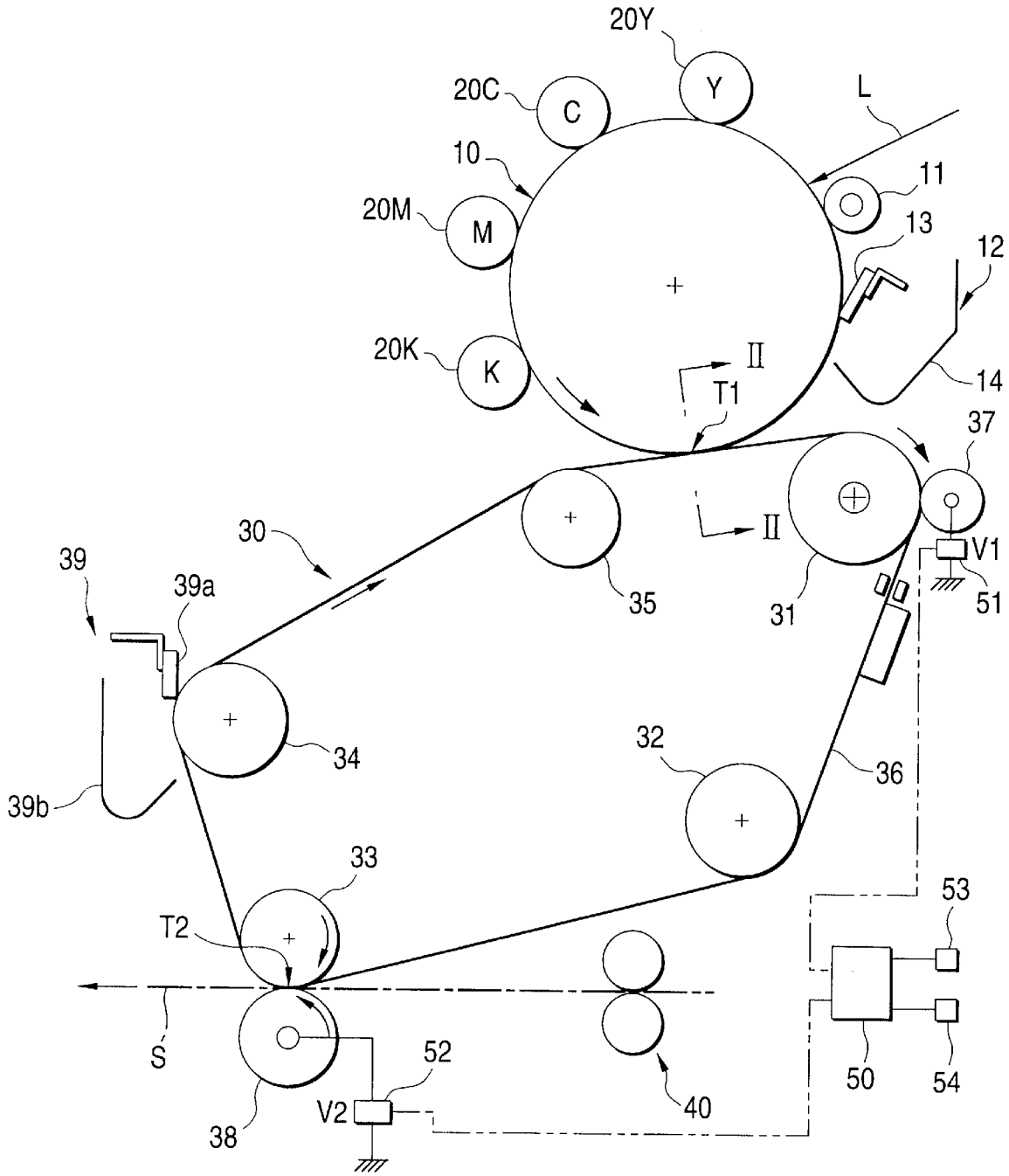
FIG. 1 is a schematic drawing showing an essential part in one embodiment of an image forming apparatus according to the present invention.
Figure 2:
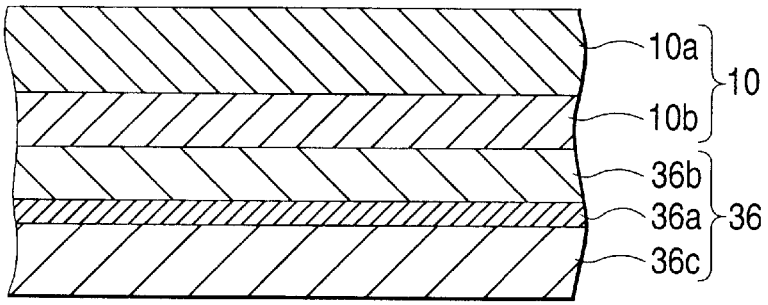
FIG. 2 is an enlarged sectional view of the part taken along the line II—II in FIG. 1.

FIG. 1 is a schematic drawing showing an essential part in one embodiment of an image forming apparatus according to the present invention and FIG. 2 is an enlarged sectional view showing the part taken along the line II—II in FIG. 1.

This image forming apparatus is an apparatus wherein a full color image can be formed using developing machines by toner in four colors of yellow, cyan, magenta and black.

As shown in FIG. 1, a reference numeral 10 denotes a photosensitive body as a latent image carrier and the photoconductor drum is rotated in a direction shown by an arrow by suitable driving means (not shown).

An charging roller 11 as charging means, developing rollers 20 (Y, M, C, K) as developing means, an intermediate transfer mechanism 30 and cleaning means 12 are arranged along its rotational direction around of the photosensitive body 10.

As shown in FIG. 2, the photosensitive body 10 is provided with a cylindrical conductive base material 10*a* and a photosensitive layer 10*b* formed on the surface of the base material 10*a*.

The charging roller 11 is abutted against the peripheral surface of the photosensitive body 10 and uniformly charges the peripheral surface. For example, the charging roller uniformly charges the peripheral surface so that it is approximately −600 V.

Selective exposure L according to desired image information is applied to the peripheral surface of the uniformly charged photosensitive body 10 by an exposing unit (not shown). In a part to which the exposure L is applied, electric potential is attenuated to approximately −100 V for example and an electrostatic latent image is formed in the part.

Toner is applied to the electrostatic latent image by the developing roller 20 to develop the electrostatic latent image and to be a toner image as a visible image. Developing bias is applied to the developing roller 20 and the electrostatic latent image is developed by sticking toner charged in negative polarity on the above part in which electric potential is attenuated.

In this embodiment, a developing roller for yellow 20Y, a developing roller for cyan 20C, a developing roller for magenta 20M and a developing roller for black 20K are provided as the developing roller. These developing rollers 20Y, 20C, 20M and 20K are constituted so that they can be selectively touched to the photosensitive body 10 and when any of them is touched thereto, any toner of yellow, cyan, magenta and black is applied to the surface of the photosensitive body 10 and an electrostatic latent image on the photosensitive body 10 is developed.

A developed toner image is transferred on an intermediate transfer belt 36 described later.

The cleaning means 12 is provided with a cleaner blade 13 for removing toner which is left on and adheres to the peripheral surface of the photosensitive body 10 after the above transfer and a receiver 14 for receiving toner removed by the cleaner blade 13.

The intermediate transfer mechanism 30 is provided with a driving roller 31, four driven rollers 32, 33, 34 and 35 and the intermediate transfer belt 36 without an end put around each roller. In this embodiment, the intermediate transfer belt 36 constitutes an intermediate transfer body.

The driving roller 31 is rotated at approximately the same speed as that of the photosensitive body 10 because a gear (not shown) fixed to the end of the driving roller is engaged with a gear for driving the photosensitive body 10 (not shown) and therefore, the intermediate transfer belt 36 is circulated in a direction shown by an arrow in FIG. 1 at substantially the same speed as that of the photosensitive body 10.

The driven roller 35 is arranged in a position in which the intermediate transfer belt 36 is abutted against the photosensitive body 10 by its own tension between the driving roller 31 and the driven roller 35 and in a part in which the photosensitive body 10 is abutted against the intermediate transfer belt 36, a primary transfer portion T1 is formed. The driven roller 35 is arranged close to the primary transfer portion T1 on the upstream side of a direction in which the intermediate transfer belt 36 is circulated.

An electrode roller 37 is arranged on the driving roller 31 via intermediate transfer belt 36 and the primary transfer voltage V1 is applied to a conductive layer 36*a* (described later) of the intermediate transfer belt 36 via electrode roller 37 by a power supply unit 51. The value of the primary transfer voltage V1 is determined as described later.

The driven roller 32 is a tension roller and urges the intermediate transfer belt 36 in a tensile direction by urging means (not shown).

The driven roller 33 is a backup roller forming a secondary transfer portion T2. A secondary transfer roller 38 as a secondary transfer member is arranged opposite to the backup roller 33 via intermediate transfer belt 36. The secondary transfer roller 38 can be touched to or detached from the intermediate transfer belt 36 by an attachment/detachment mechanism (not shown).

A power supply unit 52 as voltage applying means is connected to the secondary transfer roller 38. The power supply unit 52 applies the secondary transfer voltage V2 of the same polarity as the primary transfer voltage V1 and larger than the primary transfer voltage V1 in an absolute value to the secondary transfer roller 38 in case a secondary transfer (described later) is executed, and applies no voltage to the secondary transfer roller 38, that is, turns off the application of the secondary transfer voltage V2 in a state in which the primary transfer voltage V1 is applied to the intermediate transfer belt 36 in a predetermined period (in cleaning the secondary transfer roller 38) when the secondary transfer is not executed. Both in case there is obtained a constitution that the application of the secondary transfer voltage V2 is turned off is not adopted and in the case of constitution that voltage (the cleaning voltage) of the same polarity as the primary transfer voltage V1 and smaller than the primary transfer voltage V1 in an absolute value is applied to the secondary transfer roller 38 in a state in which the primary transfer voltage V1 is applied to the intermediate transfer belt 36 in a predetermined period at certain time when the secondary transfer is not executed, the cleaning action (described later) of the secondary transfer roller 38 is obtained. The power supply unit 52 is composed of a current attraction type of power source.

The driven roller 34 is a backup roller for a belt cleaner 39. The belt cleaner 39 is provided with a cleaner blade 39*a* touched to the intermediate transfer belt 36 for removing toner which is left on the peripheral surface and adheres to it and a receiver 39*b* for receiving the toner removed by the cleaner blade 39*a*. The belt cleaner 39 can be touched to or detached from the intermediate transfer belt 36 by an attachment/detachment mechanism (not shown).

The intermediate transfer belt 36 is composed of a multilayer belt provided with a conductive layer 36*a* and a resistance layer 36*b* formed on the conductive layer 36*a* and press-contacted to the photosensitive body 10 as shown in FIG. 2. In this embodiment, the conductive layer 36*a* is formed on an insulating base substance 36*c* made of synthetic resin and the primary transfer voltage V1 is applied to the conductive layer 36*a* via above electrode roller 37. The conductive layer 36*a* is exposed in the shape of a belt because the resistance layer 36*b* is removed in the shape of a belt at the edge of the belt 36 so that the electrode roller 37 is touched to the exposed part.

In a process in which the intermediate transfer belt 36 is circulated, a toner image on the photosensitive body 10 is transferred on the intermediate transfer belt 36 in the primary transfer portion T1 and the toner image transferred on the intermediate transfer belt 36 is transferred on a recording medium S such as paper supplied between the driven roller and the secondary transfer roller 38 in the second transfer portion T2. The recording medium S is fed from a paper feeding device (not shown) and supplied to the secondary transfer portion T2 at predetermined timing through a pair of gate rollers 40.

As shown in FIG. 1, a reference numeral 50 denotes a control section for controlling the operation of the whole image forming apparatus. A temperature sensor 53 and a humidity sensor 54 respectively for detecting the ambient temperature and the ambient humidity of the apparatus are connected to the control section 50.

The control section 50 determines the value of the primary transfer voltage V1 and the secondary transfer voltage V2 respectively applied by the above power supply units 51 and 52 based on temperature and humidity respectively detected by both sensors 53 and 54, that is, a result of the detection by both sensors 53 and 54. In the case of low temperature and low humidity, both voltage is determined so that each voltage is relatively high (For example, the primary transfer voltage V1 is set to approximately +700 V and the secondary transfer voltage V2 is set to approximately +2000 V), in the case of high temperature and high humidity, both voltage is determined so that each voltage is relatively low (for example, the primary transfer voltage V1 is set to approximately +300 V and the secondary transfer voltage V2 is set to approximately +600 V) and in the other case, for example, the primary transfer voltage V1 is set to approximately +500 V and the secondary transfer voltage V2 is set to approximately +1000 V.

If constitution that the cleaning voltage is applied without turning off the application of the secondary transfer voltage V2 when the secondary transfer roller 38 is cleaned up is adopted, difference VC between the primary transfer voltage V1 and the cleaning voltage is determined based on a result of the detection by these sensors 53 and 54 and the value of the primary transfer voltage V1 and the cleaning voltage is determined so that the difference VC in voltage is made. For example, in the case of low temperature and low humidity, the above difference VC in voltage is determined (for example, for the difference VC in voltage to be approximately 600 V, the primary transfer voltage V1 is set to approximately +700 V, the secondary transfer voltage V2 is set to approximately +2000 V and the cleaning voltage is set to approximately +100 V) so that the difference in voltage is relatively large and in the case of high temperature and high humidity, the above difference VC in voltage is determined (for example, for the difference VC in voltage to be approximately 300 V, the primary transfer voltage V1 is set to approximately +400 V, the secondary transfer voltage V2 is set to approximately +700 V and the cleaning voltage is set to approximately +100 V) so that the difference in voltage is relatively small and in the other case, for the difference VC in voltage to be approximately 500 V for example, the primary transfer voltage V1 is set to approximately +600 V, the secondary transfer voltage V2 is set to approximately +1100 V and the cleaning voltage is set to approximately +100 V.

The operation of the above whole image forming apparatus is as follows:

(i) When a printing instruction signal (an image forming signal) from a host computer or the like (a personal computer and or the like) not shown is input to the control section 50 of the image forming apparatus, the photosensitive body 10, the developing roller 20 and the intermediate transfer belt 36 are driven to rotate.

(ii) The peripheral surface of the photosensitive body 10 is uniformly charged by the charging roller 11.

(iii) Selective exposure L according to the image information of first color (for example, yellow) is applied to the uniformly charged peripheral surface of the photosensitive body 10 by an exposing unit (not shown) and an electrostatic latent image for yellow is formed.

(iv) Only the developing roller 20Y for the first color (for example, yellow) is brought into contact to the photosensitive body 10, hereby, the above electrostatic latent image is developed and the toner image of the first color (for example, yellow) is formed on the photosensitive body 10.

(v) Primary transfer voltage V1 of polarity reverse to the charging polarity of the above toner is applied to the intermediate transfer belt 36 and a toner image formed on the photosensitive body 10 is transferred on the intermediate transfer belt 36 in the primary transfer portion, that is, a part T1 in which the photosensitive body 10 and the intermediate transfer belt 36 are abutted against each other. At this time, the secondary transfer roller 38 and the belt cleaner 39 are detached from the intermediate transfer belt 36.

(vi) After toner left on the photosensitive body 10 is removed by the cleaning means 12, the electricity of the photosensitive body 10 is eliminated by static eliminating light from static eliminating means (not shown).

(vii) The above operation (ii) to (vi) is repeated if necessary. That is, each operation of second color, third color and/or fourth color is repeated according to the contents of the above printing instruction signal, a toner image according to the contents of the above printing instruction signal is overlapped and formed on the intermediate transfer belt 36.

(viii) A recording medium S is supplied at predetermined timing, immediately before or after the end of the recording medium S reaches the second transfer portion T2 (in short, at timing at which a toner image on the intermediate transfer belt 36 is transferred in a desired position on the recording medium S), the secondary transfer roller 38 is abutted against the intermediate transfer belt 36, the secondary transfer voltage V2 is applied and the toner image on the intermediate transfer belt 36 (basically a full color image) is transferred on the recording medium S.

After the above secondary transfer is finished, the application of the secondary transfer voltage V2 to the secondary transfer roller 38 is turned off at suitable timing (or the cleaning voltage of the same polarity as the primary transfer voltage V1 and smaller than the primary transfer voltage V1 in an absolute value is applied) in a state in which the secondary transfer roller 38 is abutted against the intermediate transfer belt 36 and in a state in which the primary transfer voltage V1 is applied to the intermediate transfer belt 36. Hereby, potential difference is generated between the secondary transfer roller 38 and the intermediate transfer belt 36, toner which adheres to the secondary transfer roller 38 is moved to the intermediate transfer belt 36 because of the potential difference and as a result, the secondary transfer roller 38 is cleaned up. The toner moved onto the intermediate transfer belt 36 is removed together with toner left on the intermediate transfer belt 36 after the above secondary transfer by abutting the belt cleaner 39 against the intermediate transfer belt 36.

In the meantime, the toner image is fixed on the recording medium S by passing the recording medium S through a fixing device (not shown) and afterward, the recording medium S is ejected outside the apparatus.

According to the above image forming apparatus, the following action and effect can be obtained:

(a) An electrostatic latent image is formed on the surface of the photosensitive body 10, toner charged by the developing roller 20 is applied to the surface of the photosensitive body 10 and the above latent image is visualized, the primary transfer voltage V1 of polarity reverse to the charging polarity of the above toner is applied to the intermediate transfer belt 36 abutted against the photosensitive body 10 and the above visible image is primarily transferred on the intermediate transfer belt 36 and the above visible image is transferred on a recording medium S by applying the secondary transfer voltage V2 to the secondary transfer roller 38 abutted against the intermediate transfer belt 36 via recording medium S.

As the secondary transfer voltage V2 of the same polarity as the primary transfer voltage V1 and larger than the primary transfer voltage V1 in an absolute value is applied to the secondary transfer roller 38 by the voltage applying means 52 in the secondary transfer, a visible image can be securely secondarily transferred on a recording medium S. As the application of the secondary transfer voltage V2 to the secondary transfer roller 38 is turned off (or voltage of the same polarity as the primary transfer voltage V1 and smaller than the primary transfer voltage V1 in an absolute value is applied) in a state in which the primary transfer voltage V1 is applied to the intermediate transfer belt 36 in a predetermined period when the secondary transfer is not executed, potential difference is generated between the secondary transfer roller 38 and the intermediate transfer belt 36, toner which adheres to the secondary transfer roller 38 is moved to the intermediate transfer belt 36 because of the potential difference and as a result, the secondary transfer roller 38 is cleaned up.

That is, according to the image forming apparatus equivalent to this embodiment, as voltage applied to the secondary transfer roller 38 is not required to be switched between when a visible image is transferred on a recording medium S and when the secondary transfer roller 38 is cleaned up, the secondary transfer roller 38 can be cleaned up without requiring a complicated high voltage power supply unit.

In addition, if constitution that no voltage is applied to the secondary transfer roller 38 is adopted when the secondary transfer roller 38 is cleaned up, the potential difference generated between the secondary transfer roller 38 and the intermediate transfer belt 36 is larger than potential difference in case constitution that voltage of the same polarity as the primary transfer voltage V1 and smaller than the primary transfer voltage V1 in an absolute value is applied is adopted and as a result, the secondary transfer roller 38 is more satisfactorily cleaned up.

(b) As according to image forming apparatus equivalent to this embodiment, the temperature sensor 53 and the humidity sensor 54 respectively for detecting the ambient temperature and humidity of the apparatus and the control section 50 for determining the value of the primary transfer voltage V1 based on a result of the detection by these sensors 53 and 54 are provided although potential difference required to efficiently move toner which adheres to the secondary transfer roller 38 to the intermediate transfer belt 36 is different depending upon ambient temperature and humidity, the above potential difference required to efficiently move toner which adheres to the secondary transfer roller 38 to the intermediate transfer belt 36 can be generated according to ambient temperature and humidity by determining the value of the primary transfer voltage V1 by the control section 50.

Therefore, the secondary transfer roller 38 can be more efficiently cleaned up.

Even if the cleaning voltage is applied without turning off the application of the secondary transfer voltage V2 when the secondary transfer roller 38 is cleaned up, potential difference VC between the primary transfer voltage V1 and the cleaning voltage is determined based on a result of the detection of the temperature sensor 53 and the humidity sensor 54 respectively detecting the ambient temperature and humidity of the apparatus by the control means 50 and the value of the primary transfer voltage V1 and the cleaning voltage is determined so that the potential difference VC is generated. That is, as the above potential difference VC required to efficiently move toner which adheres to the secondary transfer roller 38 to the intermediate transfer belt 36 is generated according to ambient temperature and humidity by the control section 50, the secondary transfer roller 38 can be efficiently cleaned up.

(c) As the intermediate transfer belt 36 is composed of a multi-layer body provided with the conductive layer 36*a* and the resistance layer 36*b* formed on the conductive layer 36*a* and press-contacted to the photosensitive body 10, electric potential at the secondary transfer portion T2 is substantially equal to the primary transfer voltage V1 applied to the intermediate transfer belt 36 via conductive layer 36*a*.

Assuming that the intermediate transfer body is composed of only the resistance layer as in a conventional type, since the electric potential at the secondary transfer portion T2 is considerably lower than the primary transfer voltage V1 applied to the intermediate transfer body, the primary transfer voltage V1 applied to the intermediate transfer body is required to be considerably increased so as to generate potential difference required for cleaning the secondary transfer roller 38 (that is, potential difference generated between the secondary transfer roller 38 and the intermediate transfer body by applying voltage of the same polarity as the primary transfer voltage V1 and smaller than the primary transfer voltage V1 in an absolute value to the secondary transfer roller 38 or by applying no voltage to the secondary transfer roller 38 in a state in which the primary transfer voltage V1 is applied to the intermediate transfer body). If the primary transfer voltage V1 is considerably large voltage, the secondary transfer voltage V2 is required to be further increased.

To the contrary, according to the image forming apparatus equivalent to this embodiment, since the electric potential at the secondary transfer portion T2 is substantially equal to the primary transfer voltage V1 applied to the intermediate transfer belt 36, the above potential difference required for cleaning the secondary transfer roller 38 can be generated without increasing the primary transfer voltage V1. In other words, according to the image forming apparatus equivalent to this embodiment, since the above potential difference required for cleaning the secondary transfer roller 38 can be obtained by utilizing the primary transfer voltage V1 applied to the intermediate transfer belt 36 substantially as it is, the primary transfer voltage V1 and the secondary transfer voltage V2 can be lowered.

(d) As the voltage applying means 52 is composed of a current attraction type of power source, stable electric potential can be kept even if current flows in a reverse direction to a case of transfer and electric potential required for cleaning can be secured.

Further concrete embodiments will be described below.

Figure 3:
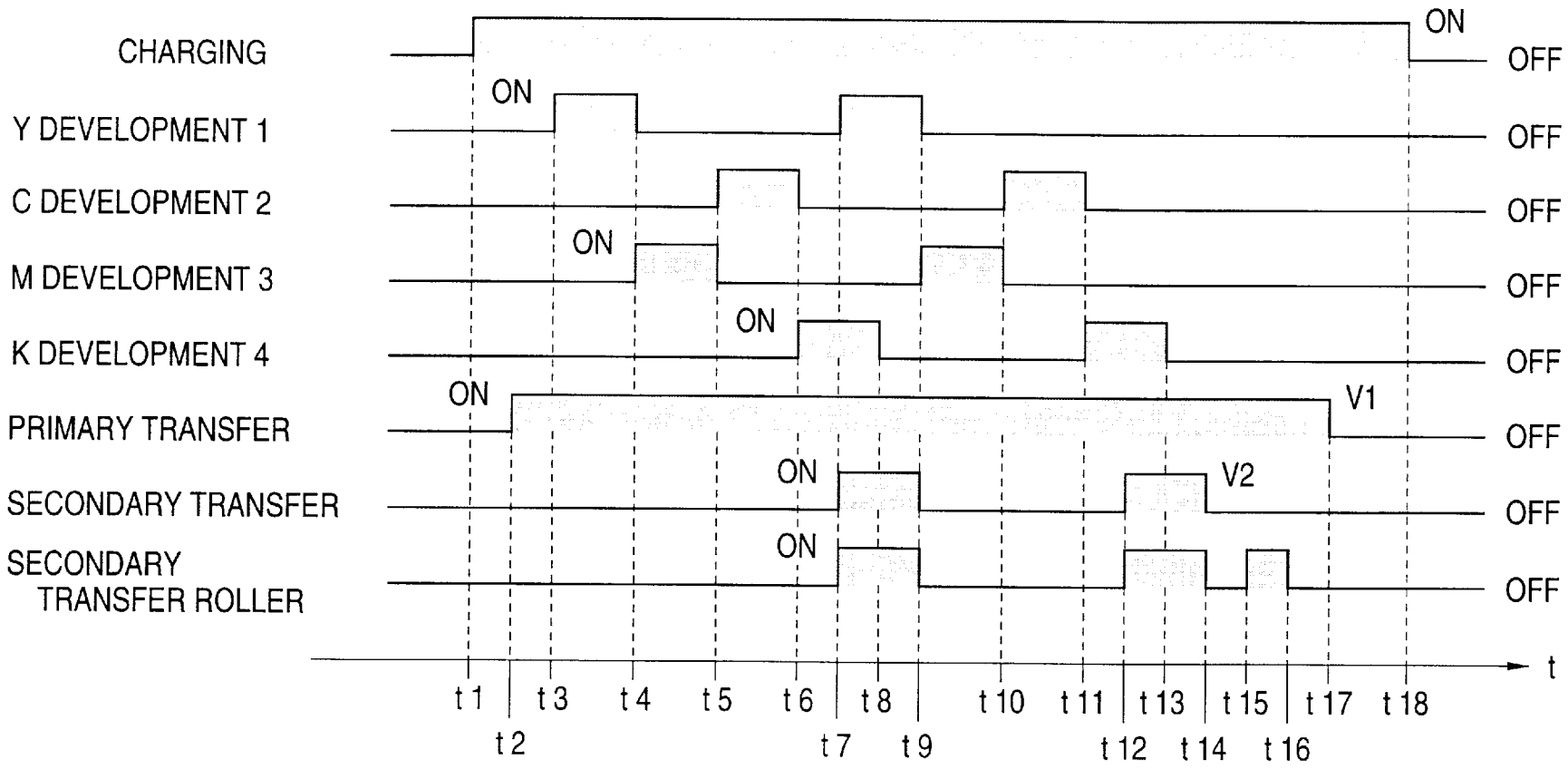
FIG. 3 is a timing chart showing one embodiment of timing at which each voltage is applied and timing at which a secondary transfer roller 38 is touched or detached.
Figure 5:
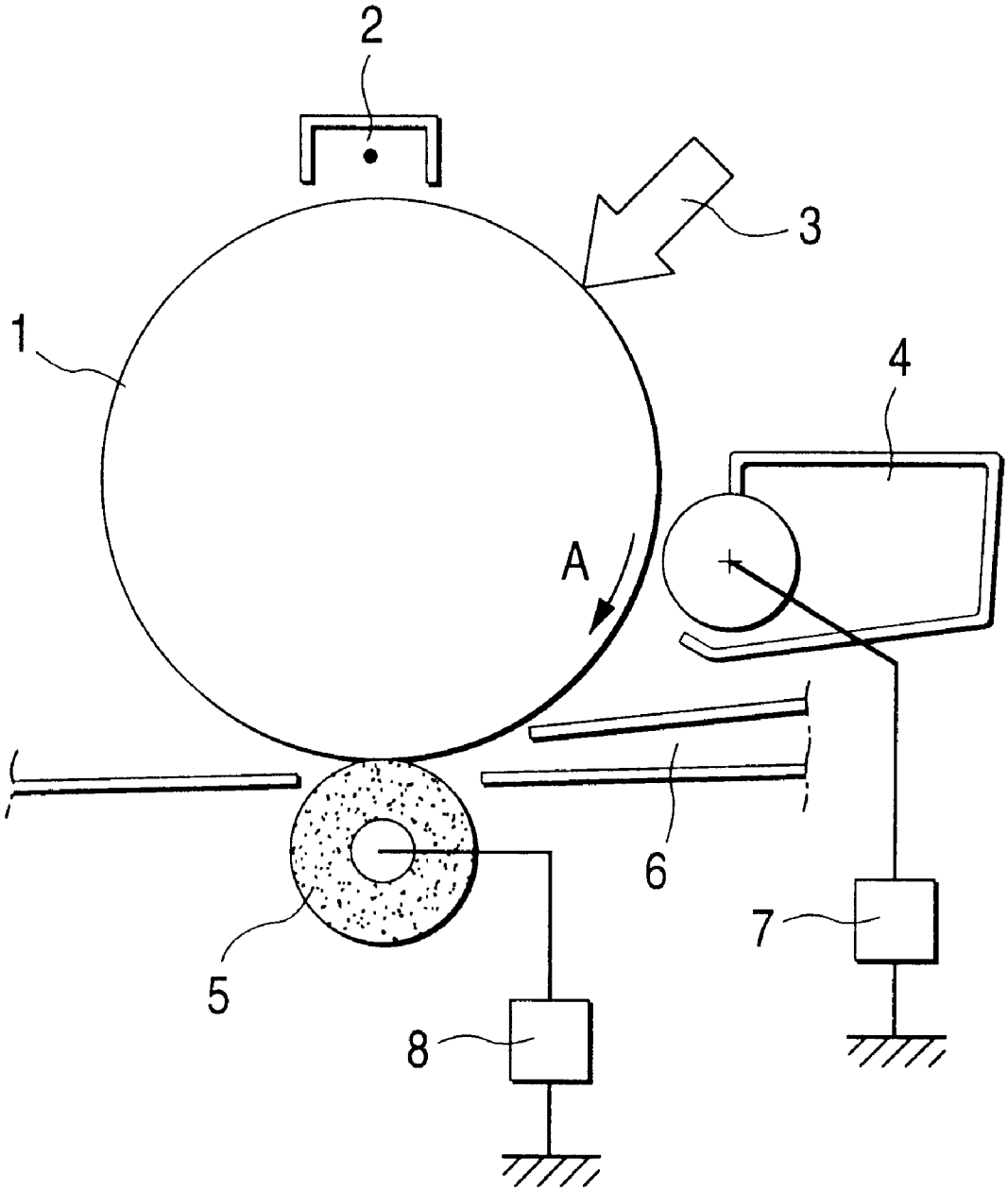
FIG. 5 is an explanatory drawing showing a conventional image forming apparatus.

FIG. 3 is a timing chart showing one embodiment of timing for applying the each voltage and timing for touching or detaching the secondary transfer roller 38.

This chart designates in case a color image is continuously transferred on two recording mediums S and afterward, the secondary transfer roller 38 is cleaned up.

Specifically, after a printing instruction signal (an image forming signal) from a host computer or the like (a personal computer or the like) (not shown) is input to the control section 50 of the image forming apparatus as described above, and the photosensitive body 10, the developing roller 20 and the intermediate transfer belt 36 are driven to rotate, charging by the charging roller 11 is started at predetermined timing t1. Afterward, the above exposure L is applied, however, in FIG. 3, it is omitted.

At t2, the primary transfer voltage V1 is applied.

At t3, the developing roller 20Y for a first recording medium is brought into contact to the photosensitive body 10 and developing bias is applied thereto.

At t4, the contact of the developing roller 20Y with the photosensitive body 10 and the application of developing bias are released, the developing roller 20M for the first recording medium is brought into contact to the photosensitive body 10 and developing bias is also applied.

At t5, the contact of the developing roller 20M with the photosensitive body 10 and the application of developing bias are released, the developing roller 20C for the first recording medium is brought into contact to the photosensitive body 10 and developing bias is also applied.

At t6, the contact of the developing roller 20C with the photosensitive body 10 and the application of developing bias are released, the developing roller 20K for the first recording medium is brought into contact to the photosensitive body 10 and developing bias is also applied.

At t7, the secondary transfer voltage V2 for the first recording medium is applied and the secondary transfer roller 38 is abutted against the intermediate transfer belt 36. Simultaneously, the developing roller 20Y for a second recording medium is brought into contact to the photosensitive body 10 and developing bias is applied.

At t8, the contact of the developing roller 20K for the first recording medium with the photosensitive body 10 and the application of developing bias are released.

At t9, the application of the secondary transfer voltage V2 for the first recording medium and the press-contact of the secondary transfer roller 38 on the intermediate transfer belt 36 are released. Simultaneously, the contact of the developing roller 20Y for the second recording medium with the photosensitive body 10 and the application of developing bias are released, the developing roller 20M for the second recording medium is brought into contact to the photosensitive body 10 and developing bias is also applied.

That is, in a period of the above time t3 to t9, a toner image is formed in the order of Y, M, C and K on the photosensitive body 10, is primarily transferred on the intermediate transfer belt 36 in order to be a color image and is secondarily transferred on a first recording medium. As clear from the above description, in a period of the time t3 to t7, only development and primary transfer are executed. In a period of the time t7 to t9, the development of the last color K for the first recording medium, primary transfer and the collective secondary transfer of the whole color are executed and the development of first color Y for a second recording medium is executed.

At t10, the contact of the developing roller 20M for the second recording medium with the photosensitive body 10 and the application of developing bias are released, the developing roller 20C for the second recording medium is brought into contact to the photosensitive body 10 and developing bias is also applied.

At t11, the contact of the developing roller 20C for the second recording medium with the photosensitive body 10 and the application of developing bias are released, the developing roller 20K for the second recording medium is brought into contact to the photosensitive body 10 and developing bias is also applied.

At t12, the secondary transfer voltage V2 for the second recording medium is applied and the secondary transfer roller 38 is abutted against the intermediate transfer belt 36.

At t13, the contact of the developing roller 20K for the second recording medium with the photosensitive body 10 and the application of developing bias are released.

At t14, the application of the secondary transfer voltage V2 for the second recording medium and the press-contact of the secondary transfer roller 38 on the intermediate transfer belt 36 are released.

Afterward, in a period of t15 and t16, the secondary transfer roller 38 is abutted against the intermediate transfer belt 36 without applying the secondary transfer voltage V2 in a state in which the primary transfer voltage V1 is applied and hereby, the secondary transfer roller 38 is cleaned up.

As described above, in this embodiment, the image forming apparatus is constituted so that every time images are transferred on two recording mediums, the secondary transfer roller 38 is cleaned up once. However, in t9 to t12, the image forming apparatus may be also constituted by bringing the secondary transfer roller 38 into press-contact to the intermediate transfer belt 36 without applying the secondary transfer voltage V2 so that every time images are transferred on one recording medium, the secondary transfer roller 38 is cleaned up.

If images are continuously transferred on three or more recording mediums, as in image forming operation for the second recording medium, the above operation that at t12, the contact of the developing roller 20Y for the third recording medium with the photosensitive body 10 and the application of developing bias are started, and at t14, the contact of the developing roller 20M for the third recording medium with the photosensitive body 10 and the application of developing bias are started is repeated.

Figure 4:
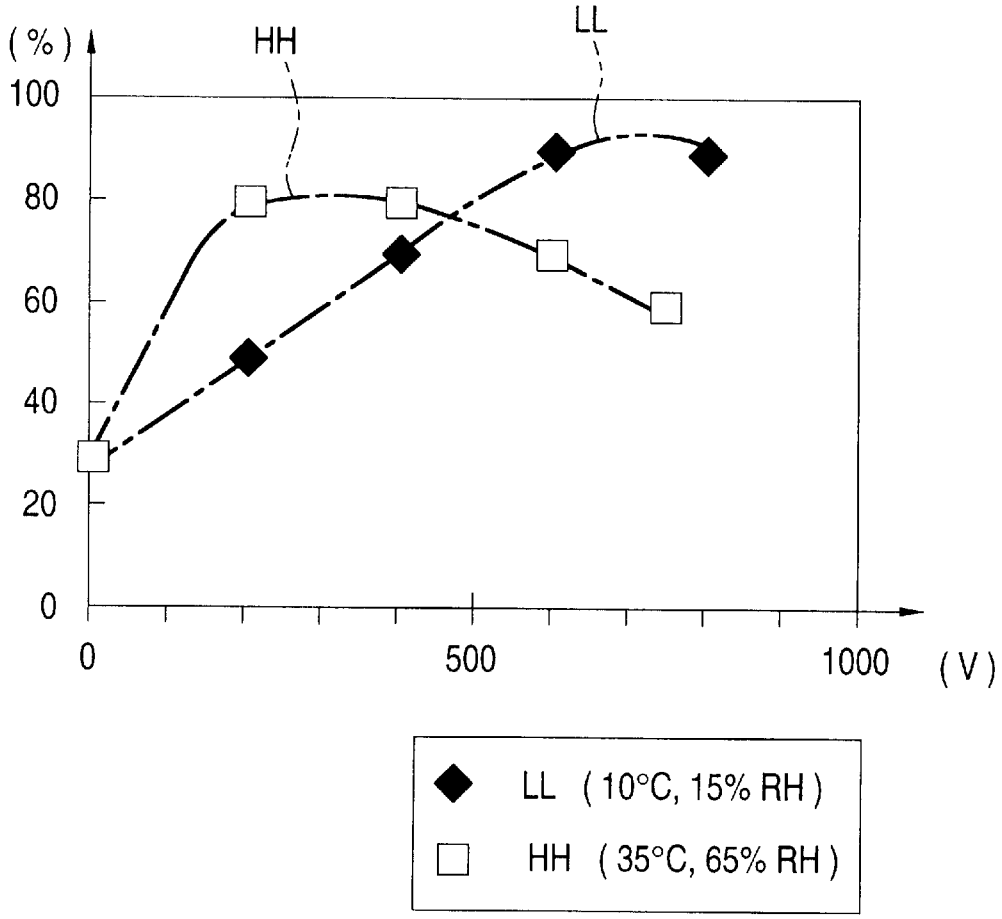
FIG. 4 shows one example of relationship among potential difference (V) between the secondary transfer roller 38 and an intermediate transfer belt 36, cleaning efficiency (%), ambient temperature and ambient humidity respectively when the secondary transfer roller 38 is cleaned up.

FIG. 4 shows one example of relationship among potential difference (V) between the secondary transfer roller 38 and the intermediate transfer belt 36, cleaning efficiency (%), ambient temperature and ambient humidity when the secondary transfer roller 38 is cleaned up. A chain line HH in FIG. 4 indicates the case of high temperature and high humidity (35° C., 65%) and a chain double-dashed line LL indicates the case of low temperature and low humidity (10° C., 15%). The above cleaning efficiency means a rate in which toner which adheres to the secondary transfer roller 38 is returned to the intermediate transfer belt 36.

As clear from FIG. 4, in the case of low temperature and low humidity (LL), high cleaning efficiency (approximately 85 to 90%) are obtained under relatively large potential difference (approximately 600 to 800 V) and in the case of high temperature and high humidity (HH), high cleaning efficiency (approximately 80 to 85%) are obtained under relatively small potential difference (approximately 200 to 400 V).

Therefore, if there is adopted a constitution that the application of the secondary transfer voltage V2 to the secondary transfer roller 38 is turned off in a state in which the primary transfer voltage V1 is applied to the intermediate transfer belt 36 when the secondary transfer roller 38 is cleaned up, it is desirable that the primary transfer voltage V1 and the secondary transfer voltage V2 are determined as follows to obtain high cleaning efficiency:

That is, it is desirable that in the case of low temperature and low humidity (LL), to obtain the potential difference of approximately 600 to 800 V, both voltage V1 and V2 is set to relatively high voltage (for example, the primary transfer voltage V1 is set to approximately +600 to +800 V and the secondary transfer voltage V2 is set to approximately +2000 to +2200 V), in the case of high temperature and high humidity (HH), to obtain the potential difference of approximately 200 to 400 V, both voltage V1 and V2 is set to relatively low voltage (for example, the primary transfer voltage V1 is set to approximately +200 to +400 V and the secondary transfer voltage V2 is set to approximately +400 to +600 V), in the other case, for example, the primary transfer voltage V1 is set to approximately +500 V and the secondary transfer voltage V2 is set to approximately +1000 V.

If there is adopted a constitution that the cleaning voltage is applied without turning off the application of the secondary transfer voltage V2 when the secondary transfer roller 38 is cleaned up, it is desirable that the primary transfer voltage V1, the secondary transfer voltage V2 and the cleaning voltage are determined as follows to obtain high cleaning efficiency:

That is, it is desirable that in the case of low temperature and low humidity (LL), to obtain the potential difference of approximately 600 to 800 V, for example, the primary transfer voltage V1 is set to approximately +700 to +900 V and the secondary transfer voltage V2 is set to approximately +2100 to +2300 V, in the case of high temperature and high humidity (HH), to obtain the potential difference of approximately 200 to 400 V, for example, the primary transfer voltage V1 is set to approximately +300 to +500 V, the secondary transfer voltage V2 is set to approximately +500 to +900 V and the cleaning voltage is set to approximately +100 V and in the other case, for example, the primary transfer voltage V1 is set to approximately +600 V, the secondary transfer voltage V2 is set to approximately +1100 V and the cleaning voltage is set to approximately +100 V.

The intermediate transfer belt 36 is constituted without an end. The insulating base substance 36*c* thereof is made of polyethylene terephthalate (PET) in the shape of a sheet. The conductive layer 36*a* is formed on the substrate 36*c* by depositing aluminum. The belt-like resistance layer 36*b* is formed by applying coating material in which fluoric particulates and $SnO_2$ as a conductive substance are dispersed based on urethane on the conductive layer 36*a* so that it is approximately 10 to 100 $\mu$m thick. Then both ends of the resistance layer 36*b* are adhered by the ultrasonic bonding. The conductive layer 36*a* is exposed in the shape of a belt by applying the coating material with the side edge of the belt left in the shape of a belt and the electrode roller 37 is brought into contact to the exposed part.

The surface electrical resistance of the resistance layer 36*b* shall be set to approximately $10^8$ to $10^{\cdot}$ Ω, the volume resistivity shall be set to approximately $10^7$ to $10^{14}$ Ωcm and the surface roughness shall be set to $R_{max}$ 1 $\mu$m (preferably, to 0.7 $\mu$m) or less.

For the primary transfer portion T1, depth in which the photosensitive body 10 is press-contacted into the intermediate transfer belt 36 is set to approximately 1.2±0.5 mm.

For a power source, a current attraction type of constant-voltage power source or a constant-voltage power source provided with a bypass resistor is used. It is desirable that the value of constant voltage is determined based on the output of the temperature and humidity sensors 53 and 54.

For the electrode roller 37, it is adopted the resistance thereof is 1 MΩ or less.

The primary transfer bias shall be turned off after the secondary transfer is finished.

For the secondary transfer portion T2, a constant-current power source is used and minimum voltage is controlled.

Conductivity is applied to the secondary transfer roller 38 by an ionic conductive substance, resistance thereof is set to $10^6$ to $10^8$ Ω, its hardness is set to 60±5° and a pressure load upon the backup roller 33 is set to 5.0 to 9.0 kg (preferably, to approximately 7.0 kg).

For toner, it is adopted high-concentration pigment toner the particle diameter of which is approximately 7 $\mu$m.

For the quantity of additives to toner, the quantity of additives of a large particle diameter is set to 0.5 to 4.0 wt % (preferably, to approximately 0.7 wt %) and the quantity of additives of a small particle diameter is set to 1.5 to 4.0 wt % (preferably, to approximately 2.0 wt %).

Additives of a large particle diameter are required mainly to enhance the durability and stability of the toner. In view of this point, the more, the better, however, when the quantity of additives of a large particle diameter exceeds 4.0 wt %, the fluidity of toner is deteriorated, and thereby it is encountered undesirable phenomenon such as a white void.

Additives of a small particle diameter are required mainly to enhance transferability on rough paper. In view of this point, the more, the better, however, when the quantity of additives of a small particle diameter exceeds 4.0 wt %, the photosensitive body 10 and the intermediate transfer belt 36 are readily filmed because of suspended silica and it is undesirable.

The fluidity of toner is set to A.D. approximately 0.35 g/cc. Charging quantity is set to −10 $\mu$C/g or more.

The quantity of toner before the secondary transfer, that is, the quantity of toner on the intermediate transfer belt 36 is set to 1.5 mg/cm$^2$ or less.

The outside diameter of the driving roller 31 is set so that the peripheral speed of the intermediate transfer belt 36 is slightly (including tolerance) faster than that of the photosensitive body 10. Specifically, the above outside diameter is set so that the peripheral speed of the intermediate transfer belt is faster by approximately 0.6±0.5%.

It is desirable that the peripheral speed of the photosensitive body 10 and that of the intermediate transfer belt 36 on which a toner image is transferred from the photosensitive body 10 are completely equal.

However, as there is tolerance between the outside diameter of the photosensitive body 10 and that of the driving roller 31, it is impossible to completely equalize the above peripheral speed. In such a situation, if the peripheral speed of the intermediate transfer belt 36 in a part in which the belt is wound on the driving roller 31 is slightly slower than the peripheral speed of the photosensitive body 10, extremely slight force which tries to loose the intermediate transfer belt 36 acts between the primary transfer portion T1 and the driving roller 31 and the state of the intermediate transfer belt 36 in the primary transfer portion T1 becomes unstable.

In this embodiment, the outside diameter of the driving roller 31 is set so that the peripheral speed of the intermediate transfer belt 36 is slightly (within a range of tolerance) faster than the peripheral speed of the photosensitive body 10.

As the intermediate transfer belt 36 is always slightly tensed between the primary transfer portion T1 and the driving roller 31 if the outside diameter of the driving roller is set as described above, the state of the intermediate transfer belt 36 in the primary transfer portion T1 becomes stable.

To enhance a friction coefficient, urethane coating is applied to the peripheral surface of the driving roller 31.

According to the constitution of the above embodiment, the following effect is obtained:

(a) Even if there is slight dispersion in the quantity of toner (the thickness of a toner layer), environment and the resistance of members, a satisfactory transfer state and a state in which the secondary transfer roller 38 is satisfactorily cleaned up are obtained.

(b) If the resistance value of the intermediate transfer belt 36 and depth in which the intermediate transfer belt is press-contacted into the photosensitive body 10 are set as described above, primary transfer is enabled at relatively low voltage (1200 V or less).

(c) An image can be prevented from being deteriorated because of interference in primary and secondary simultaneous transfer by using the above method of applying primary transfer bias.

(d) Even if there is slight dispersion in the type of paper, environment and the resistance of members, a satisfactory secondary transfer state is obtained owing to the resistance value of the intermediate transfer belt 36 and the constitution of the secondary transfer portion T2 and secondary transfer is enabled at 4000 V or less and 300 $\mu$A or less. The satisfactory cleaning state of the secondary transfer roller 38 is obtained.

(e) Satisfactory transfer is obtained even on rough paper such as bond paper, depending upon the secondary transfer roller 38, toner and the quantity of toner before secondary transfer. By deforming the surface of paper by the high-hardness and heavy-duty secondary transfer roller 38, the dust of toner by discharge is inhibited even if the quantity of additives in toner is increased and a high electric field is formed; The transfer efficiency of toner is enhanced by reducing the quantity of toner before secondary transfer as described above; The paper supplying condition becomes stable due to the high load of the secondary transfer roller 38; And the satisfactory cleaning condition of the secondary transfer roller 38 can be obtained.

(f) A so-called white void effect in the primary transfer can be prevented from occurring by adopting constitution that the intermediate transfer belt 36 is abutted against the photosensitive body 10 by its own tension (without using a transfer roller for press-contacting the belt on the photoconductor drum), including fluoric particulates in the intermediate transfer belt 36 and using toner with high fluidity.

(g) Including fluoric particulates are included in the intermediate transfer belt 36 and using toner with high fluidity, a so-called white void in the secondary transfer can be prevented from occurring even if the secondary transfer roller 38 is hard and heavy-duty as described above.

(h) Toner which adheres to the intermediate transfer belt 36 is stably carried depending upon the composition of the above toner, the above resistance value and the surface roughness of the intermediate transfer belt 36 and the dispersion of toner in the secondary transfer portion T2 is reduced.

The embodiment of the present invention and the examples are described above, however, the present invention is not limited to the embodiment or the examples and may be suitably modified within a range of the object of the present invention.

For example, in the above embodiment, an intermediate transfer body is constituted by the intermediate transfer belt 36, however, it may be also constituted by an intermediate transfer drum.

For example, in the above embodiment, the primary transfer voltage V1 is kept constant and when the secondary transfer roller 38 is cleaned up, voltage applied to the secondary transfer roller is reduced or reduced to zero, however, the secondary transfer voltage V2 is kept constant, when the secondary transfer roller 38 is cleaned up, it can be also cleaned up by increasing the primary transfer voltage V1.

As has been described heretofore, according to the present invention, the secondary transfer member can be efficiently cleaned up without requiring a complicated high voltage power supply unit.

According to the present invention, since relatively large potential difference between the secondary transfer member and the intermediate transfer body can be obtained, the secondary transfer member is more satisfactorily cleaned up.

According to the present invention, since the potential difference required for cleaning the secondary transfer member can be formed by utilizing the primary transfer voltage applied to the intermediate transfer body substantially as it is, the primary transfer voltage can be reduced.

According to the present invention, even if current flows in a reverse direction to that at the time of transfer, stable electric potential can be kept and electric potential required for cleaning operation can be secured.

What is claimed is:

1. An image forming apparatus comprising:

a latent image carrier in which an electrostatic latent image is formed on the surface thereof;

development means for applying charged developer to the surface of the latent image carrier to visualize the latent image;

an intermediate transfer body which is abutted against the latent image carrier, the intermediate transfer body to which a primary transfer voltage of polarity reverse to a charging polarity of the developer is applied and on which the visible image is primarily transferred;

a secondary transfer member which is abutted against the intermediate transfer body through a recording medium and to which a secondary transfer voltage is applied to transfer the visible image on the recording medium; and voltage applying means for applying the secondary transfer voltage of the same polarity as the primary transfer voltage and larger than the primary transfer voltage in an absolute value to the secondary transfer member in case the secondary transfer is executed, and for applying a cleaning voltage of the same polarity as the primary transfer voltage and smaller than the primary transfer voltage in an absolute value to the secondary transfer member in a predetermined period in case the secondary transfer is unexecuted.

2. The image forming apparatus as set forth in claim 1 further comprising:

a temperature sensor for detecting ambient temperature of the apparatus;

a humidity sensor for detecting ambient humidity of the apparatus; and a control section for determining potential difference between the primary transfer voltage and the cleaning voltage based on a result of the detections by the temperature sensor and the humidity sensor and for determining the value of the primary transfer voltage and the cleaning voltage so that a determined potential difference is made.

3. The image forming apparatus as set forth in claim 2, wherein the primary transfer voltage and the cleaning voltage are determined so as to the potential difference is relatively large in case low temperature and low humidity are detected by the sensors.

4. The image forming apparatus as set forth in claim 2, wherein the primary transfer voltage and the cleaning voltage are determined so as to the potential difference is relatively small in case the high temperature and high humidity are detected by the sensors.

5. The image forming apparatus as set forth in claim 1, wherein the intermediate transfer body includes a conductive layer to which the primary transfer voltage is applied.

6. The image forming apparatus as set forth in claim 1, wherein the voltage applying means is composed of a current attraction type of power source.

7. An image forming apparatus comprising:

a latent image carrier in which an electrostatic latent image is formed on the surface thereof;

development means for applying charged developer to the surface of the latent image carrier to visualize the latent image;

an intermediate transfer body which is abutted against the latent image carrier, to which a primary transfer voltage of polarity reverse to a charging polarity of the developer is applied and on which the visible image is primarily transferred;

a secondary transfer member which is abutted against the intermediate transfer body through a recording medium and to which a secondary transfer voltage is applied to transfer the visible image on the recording medium; and voltage applying means for applying the secondary transfer voltage of the same polarity as the primary transfer voltage and larger than the primary transfer voltage in an absolute value to the secondary transfer member in case the secondary transfer is executed, and for applying no voltage to the secondary transfer member to the secondary transfer member in a predetermined period in case the secondary transfer is unexecuted.

8. The image forming apparatus as set forth in claim 7 further comprising:

a temperature sensor for detecting ambient temperature of the apparatus;

a humidity sensor for detecting ambient humidity of the apparatus; and a control section for determining the value of the primary transfer voltage based on a result of the detections by the temperature sensor and the humidity sensor.

9. The image forming apparatus as set forth in claim 8, wherein the primary transfer voltage is determined so as be relatively high in case low temperature and low humidity are detected by the sensors.

10. The image forming apparatus as set forth in claim 8, wherein the primary transfer voltage is determined so as to be relatively low in case high temperature and high humidity are detected by the sensors.

11. The image forming apparatus as set forth in claim 7, wherein the intermediate transfer body includes a conductive layer to which the primary transfer voltage is applied.

12. The image forming apparatus as set forth in claim 7, wherein the voltage applying means is composed of a current attraction type of power source.

* * * * *